US005772026A

United States Patent [19]

Grigsby

[11] Patent Number: 5,772,026

[45] Date of Patent: Jun. 30, 1998

[54] MULTI-DECK CONTAINER FOR LAWN AND GARDEN TRACTORS

[75] Inventor: Charles F. Grigsby, Marietta, Ga.

[73] Assignee: North American Container Corporation, Mableton, Ga.

[21] Appl. No.: 762,566

[22] Filed: Dec. 9, 1996

[51] Int. Cl.[6] ..... B65D 85/68

[52] U.S. Cl. ..... 206/335; 206/319; 206/511; 206/600; 53/471; 220/1.5

[58] Field of Search ..... 206/335, 319, 206/320, 576, 499, 503, 509, 386, 600, 821, 511; 53/456, 458, 471; 229/919; 220/1.5, 23.83, 651, 652

[56] References Cited

U.S. PATENT DOCUMENTS

| | | | |
|---|---|---|---|
| Re. 34,557 | 3/1994 | Grigsby | 206/335 |
| 2,276,495 | 3/1942 | Kenfield . | |
| 2,361,937 | 11/1944 | Gondert . | |
| 2,488,692 | 11/1949 | Talbot . | |
| 2,965,276 | 12/1960 | Foster . | |
| 4,171,741 | 10/1979 | Fish | 206/335 |
| 4,756,417 | 7/1988 | Teixeira | 206/509 |
| 4,804,087 | 2/1989 | Smith | 206/335 |
| 4,852,756 | 8/1989 | Holladay | 206/335 |
| 4,938,350 | 7/1990 | Grigsby | 206/319 |
| 5,069,338 | 12/1991 | Grigsby | 206/335 |
| 5,096,112 | 3/1992 | Grigsby . | |
| 5,275,279 | 1/1994 | Grigsby | 206/319 |
| 5,413,224 | 5/1995 | Morron et al. | 206/335 |

FOREIGN PATENT DOCUMENTS 1265313 5/1961 France .

OTHER PUBLICATIONS

Big Pak® Yarn Tray Systems brochure. Yarn handling with recyclable, reusable, returnable systems for closed–loop shipping/storing; Bigelow Packaging; a division of Fieldcrest Cannon, Inc., Charlotte, N.C.; 1995; 2 pgs.

Load Hog–V/Core bulk boxes brochure; Wood veneer reinforced laminated bulk boxes; North American Container Corp.; 2 pgs.

*Primary Examiner*—Paul T. Sewell
*Assistant Examiner*—Luan K. Bui
*Attorney, Agent, or Firm*—Kennedy, Davis & Kennedy

[57] ABSTRACT

A multi-deck container having a bottom pallet configured with support members for receiving and supporting a lawn and garden tractor on the bottom pallet, whereby the tractor is restrained from movement relative to the bottom pallet. A corrugated paperboard body defines two opposing side walls and two opposing end walls. The corrugated paperboard body attaches at a lower portion to the bottom pallet. A plurality of cleats attach to the walls and extend from a lower portion to an upper portion thereof. The distal ends of the cleats in the upper portion of the corrugated paperboard body support a top pallet which has support members for receiving and supporting a second lawn and garden tractor thereon whereby the second tractor is restrained from movement relative to the top pallet. The pair of lawn and garden tractors are held in the multi-deck container for packing and shipping the tractors from a manufacturer to a sales center. A method of packaging a pair of lawn and garden tractors in a multi-deck container is disclosed.

9 Claims, 2 Drawing Sheets

MULTI-DECK CONTAINER FOR LAWN AND GARDEN TRACTORS

TECHNICAL FIELD

The present invention relates to cleat-reinforced corrugated containers. More particularly, the present invention relates to a double-deck cleat-reinforced corrugated paperboard container for packaging, storing, and shipping heavy durable goods, such as lawn and garden tractors, while reducing labor and materials costs associated with packaging such goods.

BACKGROUND OF THE PRESENT INVENTION

Heavy durable goods such as lawn and garden tractors have traditionally been packaged for storage and shipping in single unit containers. Typically, lawn and garden tractors have been packaged in cleated-reinforced corrugated paperboard containers. One type of such containers is known as a top-frame container. The lawn and garden tractor mounts to a wood pallet which is then enclosed by a corrugated paperboard body. Reinforcement cleats attach to at least two opposing interior walls of the corrugated paperboard body. The cleats attach to the walls in a conventional manner such as with glue, staples or combination. The corrugated paperboard body provides definition for the container, protects the durable goods within the container from damage and dust, and maintains the position of the cleats. The top of the corrugated paperboard body receives a wood top frame. The top frame communicates top load forces through the cleats to the pallet. Flaps on the corrugated paperboard body fold over from an upper edge to close the container. The wood pallet accordingly forms a base which attaches to a lower portion of the corrugated paperboard body and supports the tractor packed within the container. The top frame cooperates with the flaps of the corrugated box to close the container. The flaps provide a surface upon which another container may be stacked.

Packaging for heavy articles accordingly has two primary objectives which generally are in conflict. First, the packaging must adequately enclose, support, and protect the goods during storage and shipping. Among other benefits, successfully supporting and protecting the goods leads to reduced repair costs for damage incurred during storage and shipment. Second, the costs of the packaging must be kept relatively low. Manufacturers generally view packaging as a necessary item, but also as not providing a recognized value to the consumer. Packaging accordingly is seen as only adding costs without providing a direct perceived value to the consumer.

Often, containers for lawn and garden tractors are stacked up to four units high for efficient utilization of warehouse space. The cleats on the corrugated paperboard body transfer top loads from the top frame to the pallet. While cleat-reinforced shipping containers have proven adequately effective for packaging lawn and garden tractors, changes in distribution and environmental concerns contribute to problems with existing containers. Change in distribution techniques is significant. Previously, partially assembled lawn and garden tractors were held in the containers such as that described above. Often the seat and the steering wheel are not attached to the tractor, but are shipped separate in individual packages held within the corrugated paperboard shipping container. The tractors are packed and moved to stacks in warehouses.

Subsequently, the packaged lawn and garden tractor is removed from the warehouse, and transported by a truck to a sales center. The tractors are unpacked and the seat and steering wheel are installed. Installation of these parts, and other set-up activities to make the tractor operate takes time for experienced personnel so that the tractor can be sold to a consumer. The packaging then is disposed of in the trash or recycled. The corrugated paperboard generally can be separated and recycled. The wooden pallets can be accumulated and returned for re-use. This requires significant storage space for the sales center. Often however the wood pallet, top frame, and corrugated paperboard container are trucked away to landfills. Increased environmental concerns however are leading to changes to packaging for durable goods such as lawn and garden tractors. The use of landfills to receive wood pallets, top frames, and corrugated containers is discouraged. Due to these environmental concerns and costs for storing and returning components of packaging, the trend is to reduce the use of nonrecycleable materials in packaging.

Changes in distribution are also leading to changes in packaging. Some retailers are now requiring the lawn and tractors to come fully assembled with the seat and handle bar in position and the other set-up needs completed by the manufacturer. The sales center no longer requires a mechanic to install the seat and the steering wheel and set-up the tractor. Rather, the lawn and garden tractors are merely unpacked and placed on the sales floor for sale. Further, improved distribution, tracking and monitoring of sales enables just-in-time shipments of tractors to retail centers from the manufacturer, instead of moving the tractors to a central warehouse. With improved tracking of the sales and improved distribution, the manufacturer can ship a smaller number of units directly to the retail center for sale.

Accordingly, there is a need in the art for an improved container for lawn and garden tractors which overcomes drawbacks associated with previously used cleat-reinforced corrugated paperboard containers. It is to such that the present invention is directed.

BRIEF DESCRIPTION OF THE PRESENT INVENTION

The present invention meets the need in the art for improved cleat-reinforced corrugated paperboard containers by providing a multi-deck container for packaging, storing, and shipping lawn and garden tractors. The multi-deck container includes a bottom pallet that is configured with support members for receiving and supporting a lawn and garden tractor on the pallet whereby the tractor is restrained from movement relative to the bottom pallet. A corrugated paperboard body attaches at a lower portion to the bottom pallet. The corrugated paperboard body defines two opposing side walls and two opposing end walls, which enclose the tractor on the bottom pallet. A plurality of cleats attach to the walls and extend from a lower portion to an upper portion of the body. The distal ends of the cleats in the upper portion of the corrugated paperboard body support a top pallet. The top pallet is configured with support members for receiving and supporting a second lawn and garden tractor thereon whereby the second tractor is restrained from movement relative to the top pallet. The multi-deck container accordingly holds a pair of lawn and garden tractors for packing, storing, and shipping the tractors from a manufacturer to a sales center.

In preferred embodiments, the plurality of cleats comprise a pair of end cleats attached to each of the end walls and at least one side cleat attached to each of the side walls. The top pallet is preferably nestingly received on the distal ends of the cleats. The upper portion of the corrugated paperboard body defines a skirt which overlaps an exterior perimeter of the top pallet. The upper portion of the corrugated paperboard body is attached to the top pallet.

The present invention further provides a method of packaging a pair of lawn and garden tractors for storage and shipping from a manufacturer to a sales center whereby the packaging costs for the pair of lawn and garden tractors is reduced from the costs of packaging the pair of lawn and garden tractors separately. The method first mounts a lawn and garden tractor to a bottom pallet which is configured with support members for receiving and supporting the lawn and garden tractor on the pallet whereby the tractor is restrained from movement relative to the bottom pallet. The method then encloses the lawn and garden tractor with a corrugated paperboard body. The body defines two opposing side walls and two opposing end walls, which walls include a plurality of cleats that extend from a lower portion of the body to an upper portion thereof. A second lawn and garden tractor is then attached to another pallet which is configured with support members for receiving and supporting a lawn and garden tractor whereby the second lawn and garden tractor is restrained from movement relative to the pallet. The pallet with the second lawn and garden tractor thereon is then positioned onto the upper end of the corrugated paperboard body in supporting contact with the distal ends of the cleats in the upper portion of the corrugated paperboard body. The corrugated paperboard body attaches at upper and lower portions to the top and bottom pallets.

DETAILED DESCRIPTION OF THE PREFERRED EMBODIMENTS

Figure 1:
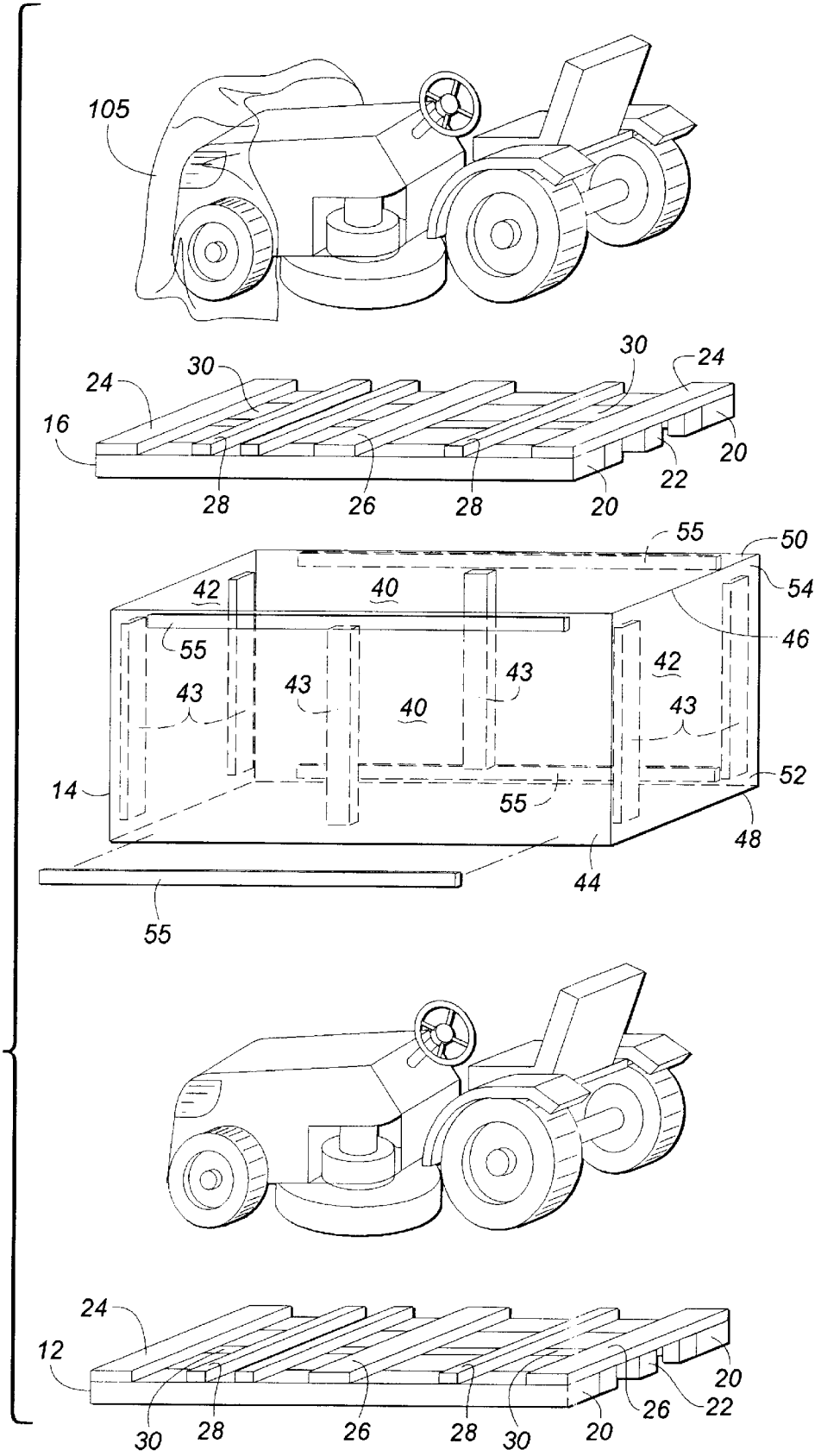
FIG. 1 is a perspective exploded view of a multi-deck cleat-reinforced corrugated paperboard container according to the present invention.

Referring now in more detail to the drawings, in which like numerals indicate like parts throughout the several views, FIG. 1 is a perspective exploded view of a multi-deck cleated-reinforced corrugated container 10 for packaging lawn and garden tractors for shipping and storage. The multi-deck container 10 includes a bottom pallet 12, a cleated corrugated paperboard body 14 and a top pallet 16. The bottom pallet 12 and the top pallet 16 are identical in construction. The pallets 12, 16 in the illustrated embodiment each support a typical four-wheel garden tractor having a heavy engine mounted between a driver's seat and a pair of front wheels. The pallets 12, 16 include a pair of outside runners 20 and a middle runner 22. The runners 20 and 22 are connected together by a pair of end cross members 24 and a central cross member 26. Wheel chocks are defined by cross members 28 which are spaced-apart from the respective end cross members 24. The wheel chocks 28 cooperate with the end cross members 24 to define gaps generally designated 30 for receiving the lower arcuate sections of the wheels of a lawn and garden tractor held on the pallets 12, 16.

The corrugated paperboard body 14 of the container 10 defines four planer walls comprising a pair of opposing side walls 40 and a pair of opposing end walls 42. In the embodiment illustrated in FIG. 1, a plurality of cleats 43 are attached to the interior surface of the walls 40 and 42. The cleats 43 are preferably hardwood boards, but may be manufactured structural members according to the teachings of U.S. Pat. No. 5,520,982. The cleats 43 extend from a lower portion of the body 14 generally designated 44 to an upper portion thereof generally designated 46. The cleats 43 are preferably spaced apart from a lower edge 48 and an upper edge 50 to define a lower gap 52 and an upper gap 54. These gaps 52, 54 permit the corrugated paperboard body 14 to overlap exterior faces of the pallet runners 20 in the pallets 12, 16. Elongated strips 55 attach to the lower portion 44 and the upper portion 46, for a purpose discussed below. The strips 55 are wood, fibre board, or similar dense material.

Figure 2:
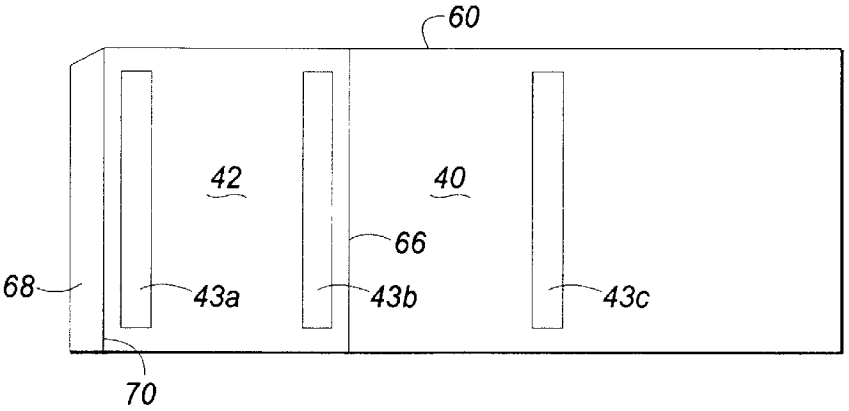
FIG. 2 is a plan view of a corrugated paperboard blank for forming the corrugated paperboard body of the multi-deck container illustrated in FIG. 1.

Alternate embodiments of corrugated paperboard blanks are described below for assembling the corrugated paperboard body 14 useful in the present invention. FIG. 2 illustrates in plan view a corrugated paperboard blank 60 which defines an end panel 42 and a side panel 40 separated by a score 66. A manufacturers joint 68 is defined in the blank 60 by a score 70. A plurality of cleats 43 attach to the blank 60 by glue, staples, or a combination. In the illustrated embodiment, a pair of cleats 43*a*, 43*b* attach to the blank 60 adjacent side edges of the panel 42. A third cleat 43*c* attaches to the side panel 40.

To form the corrugated paperboard body 14 shown in FIG. 1, a pair of the blanks 60 are joined together end-to-end. The manufacturers joint 68 of one blank 60 overlaps a respective exterior side portion of the end panel 42 of the second blank 60. The two blanks 60 are joined together with adhesive, staples, or a combination.

Figure 3:
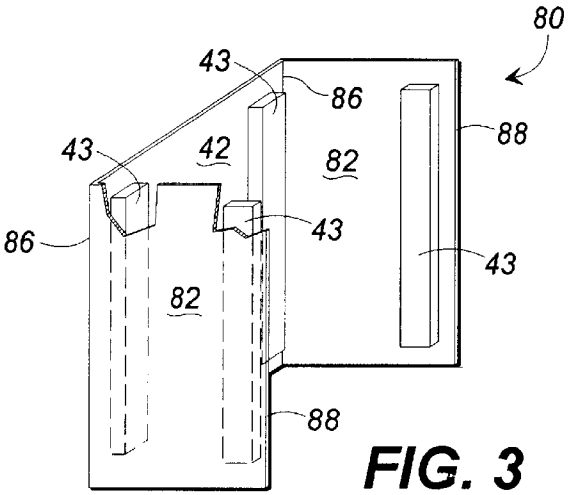
FIG. 3 is a perspective view of a second alternate embodiment a corrugated paperboard blank for forming the corrugated paperboard body of the multi-deck container illustrated in FIG. 1.

FIG. 3 illustrates in perspective view a second alternate embodiment of a corrugated paperboard blank 80 for assembly the body 14 shown in FIG. 1. In this embodiment, the blank 80 defines a pair of partial side panels 82 and an end panel 42. The panels 82 and 42 are separated by foldable scores 86. A plurality of cleats 43 are attached to the blank 80. Preferably one cleat 43 is attached to each of the opposing partial sides 82 adjacent a distal edge portion 88 of the respective side panel. A pair of cleats 43 similarly mount to the end panel 42 near the scores 86.

Two of the blanks 80 are used to define the opposing ends 42 and portions of the sides 40 of the corrugated paperboard body 14. It is noted that the partial side panels 82 extend only a portion of the length of the container. The two aligned partial sides 82 may therefore leave an opening in the sides of the container 10 between the edges 88 of the panels 82. In an alternate embodiment (not illustrated), such opening is closed by a separate sheet of corrugated paperboard. The blank 80 is folded on the socres 86 to define a U-shaped end portion of the body 14 which is received around the pallet 12. The lower portion of the blank 80 is secured to the pallet 12. The second blank 80 is similarly folded, and then attached to the lower pallet 12 at the opposing end. The top pallet 16 is then received in the upper portion of the folded blanks 80. The upper portions of the blanks 80 are attached to top pallet 16.

Figure 4:
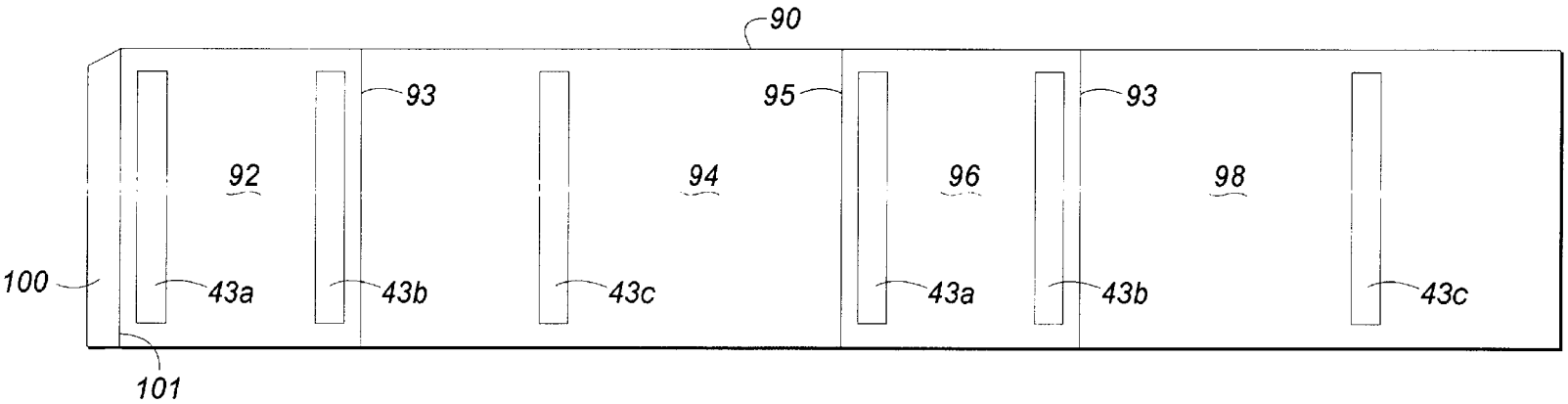
FIG. 4 is a plan view of a third alternate embodiment of a corrugated paperboard blank for forming the corrugated paperboard body of the multi-deck container illustrated in FIG. 1.

FIG. 4 is a plan view of an alternate embodiment of a corrugated paperboard blank 90 for forming the corrugated paperboard body 14 shown in FIG. 1. The blank 90 includes four main panels 92, 94, 96, and 98 foldably connected along scores 93, 95, and 97. A manufacturers joint 100 is foldably connected to the blank 90 along a score line 101. The panels 92 and 96 define the opposing end walls 42 of the corrugated paperboard body 14 and the panels 94 and 98 define the opposing side walls 40 of the body.

The corrugated paperboard blank 90 is provided with a plurality of cleats 43. In the illustrated embodiment, each of the panels 92 and 96 include a pair of spaced apart cleats 43*a*, 43*b* which are positioned adjacent the sides of the respective panels. In the illustrated embodiment, the panels 94 and 98 each include a single cleat 43*c* spaced between the edges of the panels 94, 98 as defined by the score lines 93, 95 and 97, 101, respectively. In an alternate embodiment, (not illustrated) cleats are attached only to the side panels 94, 98 with a cleat attached near each score 93 and 95 on the panel 94 and near the score 97 and an end edge 102.

In use, the blank 90 is folded on the scores 93, 95, 97, and 101 to form the corrugated paperboard body 14. The manufacturers joint 100 overlaps an exterior edge portion of the panel 98 and is secured thereto with adhesive and staples.

The multi-deck container 10 according to the present invention operates to provide packaging for heavy durable goods such as a pair of lawn and garden tractors, for storage and shipping from a manufacturer to a sales center. With reference to FIG. 1 a lawn and garden tractor is mounted to the bottom pallet 12 which is configured with cross members for receiving and supporting a lawn and garden tractor on the pallet 12. Arcuate portions of the wheels of the lawn and garden tractor are received in the gaps 30 between the end members 24 and the chock members 30. This restrains the tractor from movement relative to the bottom pallet 12. Further, conventional strapping or bands is used to secure the tractor to the pallet 12 to prevent movement during shipment and storage. The lawn and garden tractor mounted on the bottom pallet then is enclosed in a corrugated paperboard body 14. Disclosed herein are three alternate embodiments of corrugated paperboard blanks 60, 80, and 90 for defining the corrugated paperboard body 14. Each embodiment can be shipped to the tractor manufacturer in a stack of knocked-down or "KD" components. The term "knock-down" refers to components which are shipped separately and subsequently assembled to form a corrugated paperboard container. Generally, KD components require reduced shipping space in trucks compared with the space required for assembled containers.

As discussed above, each of the blanks 60, 80, and 90 define the corrguated body 14. After assembly of the corrugated paperboard body 14, the body is then attached at the lower portion 44 to the bottom pallet. The elongated strip 55 is first positioned along the lower portion 44 of the body 14. The body 14 is then secured to the bottom pallet 12 by a plurality of staples driven through the strip 55 and the wall 40 of the paperboard body 14 into the runners 20 of the bottom pallet 12. The strips 55 reinforce the stapled connection between the walls 40 and the pallet 12.

The second lawn and garden tractor is then mounted to the top pallet 16. As discussed above, arcuate portions of the tractor wheels are received in the gaps 30 between the end cross members 24 and the top cross members 28, which cooperate to receive and support a lawn and garden tractor. The top pallet 16 with the second lawn and garden tractor is then positioned on the upper portion of the container 10 and secured thereto. In the illustrated embodiment, the top pallet 16 is nestingly received within the open upper portion 48 of the corrugated paperboard body 14. The upper portion 54 of the body 14 overlaps the exterior faces of the runners 20 in the top pallet 16. The strip 55 is positioned along the upper portions 46 of the side walls 40. Staples are then driven through the strips 55 and the walls 40 to join the upper portion of the corrugated paperboard body 14 to the top pallet 16. To protect against dust and dirt, the tractor on the top pallet 16 is wrapped in plastic sheets. An absorbent material is preferably packed with the tractor to absorb moisture.

After the multi-deck container 10 with the pair of tractors is delivered to the sales center, the lawn and garden tractors are unpackaged from the container 10. This is accomplished by removing the plastic wrapping from the lawn and garden tractor mounted on the top frame 16. An elongated ramp is secured to the upper pallet 16. The tractor is guided down the ramp to the sales floor. The top pallet 15 is separated from the body 14 which is then detached from the lower pallet 12. The tractor on the lower pallet 12 is removed to the sales floor.

The principles, preferred embodiments, and modes of operation of the present invention have been described in the foregoing specification. While preferred embodiments for use with lawn and garden tractors are disclosed, the present invention would be useful with other heavy, durable goods. The invention is not to be construed as limited to the particular form disclosed, because these are regarded as illustrative, rather than restrictive. Moreover, variations and changes may be made by those skilled in the art without departing from the spirit of the invention as described by the following claims.

What is claimed is:

1. A multi-deck container for lawn and garden tractors, comprising:

a bottom pallet configured with support members for receiving and supporting a lawn and garden tractor on the bottom pallet, whereby the tractor is restrained from movement relative to the bottom pallet;

a corrugated paperboard body defining two opposing side walls and two opposing end walls, said corrugated paperboard body attaching at a lower portion to the bottom pallet;

a plurality of cleats attached to said walls and extending from a lower portion to an upper portion thereof;

a top pallet supported on the distal ends of the cleats in the upper portion of the corrugated paperboard body, and configured with support members for receiving and supporting a second lawn and garden tractor thereon whereby the second tractor is restrained from movement relative to the top pallet, whereby the pair of lawn and garden tractors are held in the multi-deck container for packing and shipping said tractors from a manufacturer to a sales center.

2. The multi-deck container as recited in claim 1, wherein said corrugated paperboard body is attached at the upper portion to the top pallet.

3. The multi-deck container as recited in claim 1, wherein said plurality of cleats comprises:

a pair of end cleats attached to each of the end walls and extending from the lower portion to an upper portion of the body; and at least one side cleat attached to each of the side walls and extending from the lower portion to the upper portion of the body.

4. The multi-deck container as recited in claim 1, wherein said distal ends of the end cleats and the side cleats are recessed from an edge of the upper portion of the corrugated paper body; and wherein said top pallet is nestingly received on the distal ends with the upper portion of the corrugated paperboard body defining a skirt which overlaps an exterior perimeter of the top pallet; and the upper portion of the corrugated paperboard body is attached to the top pallet.

5. The multi-deck container as recited in claim 1, wherein said bottom and top pallets each include pairs of spaced-apart cross members, each pair receiving a lower arcuate portion of one of the tires of the lawn and garden tractor for restraining the tire from movement relative to the pallet.

6. The multi-deck container as recited in claim 1, wherein said corrugated paperboard body is defined by a pair of corrugated paperboard blanks joined together at distal ends and each of said blanks defining a side wall and an end wall foldingly separated by a score in the blank.

7. The multi-deck container as recited in claim 1, wherein said corrugated paperboard body comprises a blank of corrugated paperboard scored for folding to provide said two opposing side walls and two opposing end walls, said blank folded on the scores and joined at distal ends to form a tubular body for mating engagement to said bottom pallet.

8. The multi-deck container as recited in claim 1, wherein said corrugated paperboard body comprises a pair of corrugated paperboard blanks, each folded along a pair of spaced-apart scores to define an end wall and opposing partial side walls that extend a portion of the length of the bottom pallet, said partial side walls each including a cleat adjacent a side edge thereof distal from the end wall.

9. A method of packaging a pair of lawn and garden tractors for storage and shipping from a manufacturer to a sales center whereby the packaging costs for the pair of lawn and garden tractors is reduced from the costs of packaging said pair of lawn and garden tractors separately, comprising:

mounting a lawn and garden tractor to a bottom pallet which is configured with support members for receiving and supporting a lawn and garden tractor on the pallet whereby the tractor is restrained from movement relative to the bottom pallet;

enclosing the lawn and garden tractor in a corrugated paperboard body which defines two opposing side walls and two opposing end walls, said walls including a plurality of cleats attached thereto which cleats extend from a lower portion of the body to an upper portion thereof;

attaching said corrugated paperboard body at a lower portion to the bottom pallet;

mounting a second lawn and garden tractor to a top pallet which is configured with support members for receiving and supporting a lawn and garden tractor on the top pallet whereby the second lawn and garden tractor is restrained from movement relative to the top pallet;

positioning said top pallet with said second lawn and garden tractor thereon onto the upper end of the corrugated paperboard body in supporting contact with the distal ends of the cleats in the upper portion of the corrugated paperboard body, whereby said pair of lawn and garden tractors are held in the multi-deck container for packing and shipping said tractors from a manufacturer to a sales center.

* * * * *

UNITED STATES PATENT AND TRADEMARK OFFICE

CERTIFICATE OF CORRECTION

PATENT NO. : 5,772,026

DATED : June 30, 1998

INVENTOR(S) : Grigsby

It is certified that error appears in the above-identified patent and that said Letters Patent is hereby corrected as shown below:

Column 4, line 37, delete "end panel 42" and replace with --side panel 40--.

Column 4, line 58, delete "socres" and replace with --scores--.

Column 6, line 8, after "sheets" insert --105 partially illustrated in Fig. 1--.

Signed and Sealed this

Ninth Day of February, 1999

*Attest:*

*Attesting Officer*

*Acting Commissioner of Patents and Trademarks*